United States Patent [19]

Hartz et al.

[11] 4,069,536

[45] Jan. 24, 1978

[54] GOLF CLUB WASHER

[76] Inventors: Robert E. Hartz, 2898 Westland Road, Muskegon, Mich. 49441; Charles J. Rien, 3337 Highland, Muskegon Heights, Mich. 49444

[21] Appl. No.: 735,514

[22] Filed: Oct. 26, 1976

[51] Int. Cl.[2] ..... A46B 11/00; A63B 57/00

[52] U.S. Cl. ..... 15/104.92; 15/160

[58] Field of Search ..... 15/3.13, 21 A, 21 B, 15/74, 97 R, 101, 104.92, 112, 160, 161, 210 R, 218.1; 273/32 G

[56] References Cited

U.S. PATENT DOCUMENTS

| | | | |
|---|---|---|---|
| 772,441 | 10/1904 | Taplin | 15/21 A UX |
| 1,530,538 | 3/1925 | Affeldt | 273/32 G |
| 2,597,148 | 5/1952 | Joseph | 15/3.13 |
| 2,790,192 | 4/1957 | O'Dowd | 15/160 |
| 3,121,897 | 2/1964 | Lambrich | 15/74 |
| 3,224,029 | 12/1965 | Domingos | 15/104.92 |
| 3,583,018 | 6/1971 | Fink | 15/160 X |
| 3,784,996 | 1/1974 | Ambrose | 15/21 A |
| 3,872,534 | 3/1975 | Hoag | 15/21 B |

*Primary Examiner*—Daniel Blum
*Attorney, Agent, or Firm*—McGarry & Waters

[57] ABSTRACT

The golf club washer has a liquid containing box structure. The box structure has a hinged upper portion. The upper portion has an open top surface. Two spongeous rolls are mounted in the upper portion of the box so that a narrow gap exists therebetween. The rolls are suspended so a club can have its top surface abut the lower portion of the rolls. The spongeous rolls have their outer surface lined with a synthetic grass. The synthetic grass has a web with a plurality of apertures therethrough and resilient grass-like bristles outwardly extending from the web. The bottom portion of the box structure is lined with a synthetic grass and a plastic container is placed therein. A solution can be placed within the plastic container. A golf club is manually washed by being inserted through the gap and rubbed against the synthetic grass bristled surface. The spongeous rolls are depressable by a club and allow passage of the club through the enlarged gap to the interior of the box structure. The solution within the plastic container wets the club to provide for a better cleaning medium. Repeated agitation of the club against the spongeous rolls cleans the golf club from any dirt, grass, sand, or mud which may be adhered thereto.

13 Claims, 5 Drawing Figures

GOLF CLUB WASHER

BACKGROUND OF THE INVENTION

1. Field of the Invention

This invention relates to a golf club washing device and more particularly to a manually operated golf club washing device for use on a golf course.

2. Description of the Prior Art

Man, in his quest to perfect his golf game, has improved the design and materials from which his golf clubs are made, the bounce and flight of a variety of golf balls, and the design of the golf bag in which the golf clubs are placed. Whatever design or variation of golf clubs and golf balls an individual person may choose, it is of overall importance to keep the clubs and balls clean from any dirt, sand, grass, or mud which may be adhered to them during a round of golf. The cleanliness of the equipment is extremely important in improving or maintaining the status of the players's game. A lump of dirt adhered to a golf club may prevent proper contact of the club with the ball thereby rendering an awful shot. It is also important to have clean clubs so that any mud and dirt from the golf course will not be transported to the locker room or the golfer's home.

Various golf club head cleaners have been made. One such device is disclosed in the U.S. Pat. No. 3,872,534 issued to Hoag on Mar. 25, 1975. The Hoag patent discloses a washing device wherein rollers are mounted within a tank. The rollers are operably connected to a motor so that when a golf club is placed therebetween, the rollers can automatically rotate. The rollers have brush bristles which clean the golf club. The top opening of the tank has two sets of bristles in opposed and overlapping contact. The club is passed through the bristles to be placed between the rollers Another golf club washer is disclosed in the U.S. Pat. No. 3,148,396 issued to Smith on Sept. 15, 1964. The Smith golf club washer has two sets of rollers with bristles that rotate. One set of bristles is arranged so a wood club may be positioned therebetween and another set of bristles is arranged so that an iron may be positioned therebetween. An electric motor rotates the bristles to clean the club heads. A cleaning solution is supplied at a point just over the bristled rollers.

A portable golf ball and golf club washer is disclosed in the U.S. Pat. No. 3,380,095 issued to Piper Jr. on Apr. 30, 1968. The piper reference discloses a container which has a resilient liquid retaining first wall wherein a golf ball is placed adjacent to and rubs against the surface to be cleaned. A cover has its bottom surface covered with the spongy liquid retaining material wherein when the cover is open the golf club may rubbed against it to be cleaned.

SUMMARY OF THE INVENTION

According to the invention, a golf club washer comprises a container with an aperture therethrough and at least one spongeous resilient pad mounted within the container and having an edge thereof aligned with the aperture for allowing a golf club to be placed through the aperture and engage the cleaning pad. The pad is placed within the container so the upper surface of the golf club can engage the lower portion of the pad. Preferably two cleaning pads are horizontally mounted within the aperture so that a golf club may be positioned therebetween. The cleaning pads are preferably placed so a narrow gap lies between the spongeous material of the two pads. The spongeous material of the cleaning pad is depressable to allow expansion of the gap to allow the golf club to be inserted therein. The exterior surface of the cleaning pad is preferably a flexible sheet of material connected to a resilient spongeous pad. The sheet of material has a plurality of outwardly extending bristles which flex under exertion of a golf club. Preferably the sheet of material has a plurality of apertures therethrough to allow passage of liquid solution to and from the spongeous interior where water can be retained. Preferably, the sheet of material is a plastic synthetic grass having a web with apertures therethrough and a plurality of flexible grass-like bristles extending outwardly from the web.

In one embodiment, a cleaning pad had a flattened back side which lies adjacent an inside surface of the container and is attached thereto. In one embodiment, two cleaning pads are placed parallel to each other wherein each cleaning pad is attached to an opposite inside surface of the container, leaving a narrow gap between the two pads.

Preferably, the mounting means mounting the cleaning pad onto the horizontal surface includes a hook extending outwardly and downwardly from the back surface of the cleaning pad and engaging a protrusion secured to the inside surface of the container.

Preferably, the container has an upper section and lower section pivotably connected. The upper section has the two pads mounted thereto. Preferably the upper section has four side walls and an open top and bottom.

The lower section has a bottom, and four sides for holding liquid. The lower section has an open top which is aligned with the open bottom of the top section. The top section can be pivotably moved to expose the open top of the bottom section.

Preferably, the bottom section has an interior lined with a synthetic grass and has a small plastic dish therein cushioned by the flexible bristles of the synthetic grass. The dish lies below the narrow gap between the two cleaning pads and is large enough to receive a golf club head therein.

The golf club washer is preferably anchored to the ground by means of two long rods engaging the container and extending down below the ground surface. Preferably the rods extend through two angled apertures in the bottom portion of the container.

Preferably, a dry towel is mounted on an upwardly extending flexible rod. The flexible rod is mounted to an exterior portion of the golf club washer.

A golf club head can be positioned between the two cleaning pads, passed therethrough, and dipped in a solution contained in the dish. The club head can then be agitated repetitively through the narrow gap depressing the cleaning pads each time it passes therebetween. The solution may be absorbed by the spongeous interior of the cleaning pads and when depressed, the liquid can then be squeezed out onto the club head.

In this fashion, a club head washer is provided that can clean both irons and woods on a golf course wherein electrical power may be unavailable.

BRIEF DESCRIPTION OF THE DRAWINGS

Reference will now be made to the drawings wherein.

DETAILED DESCRIPTION OF THE PREFERRED EMBODIMENT

Figure 1:
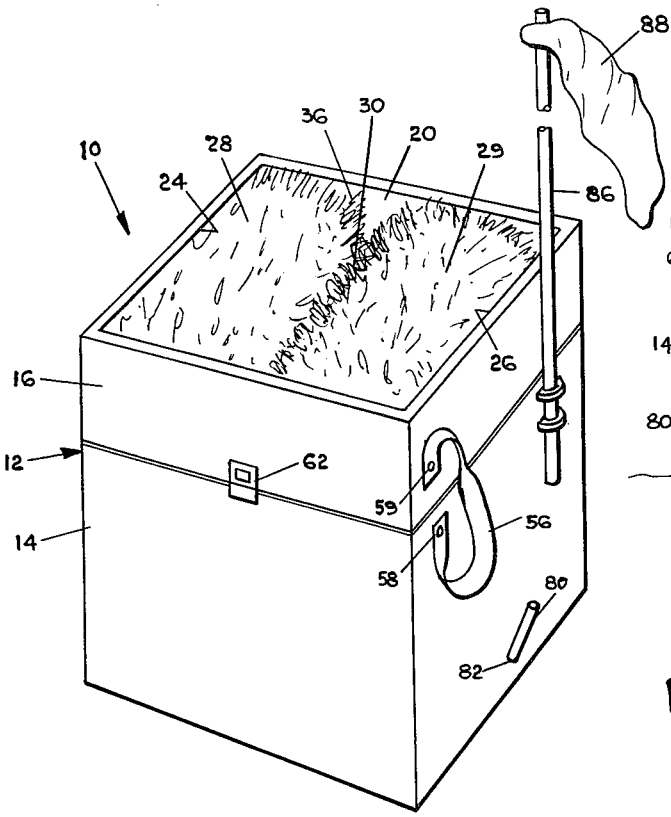
FIG. 1 is a front perspective view of an embodiment according to the invention.
Figure 2:
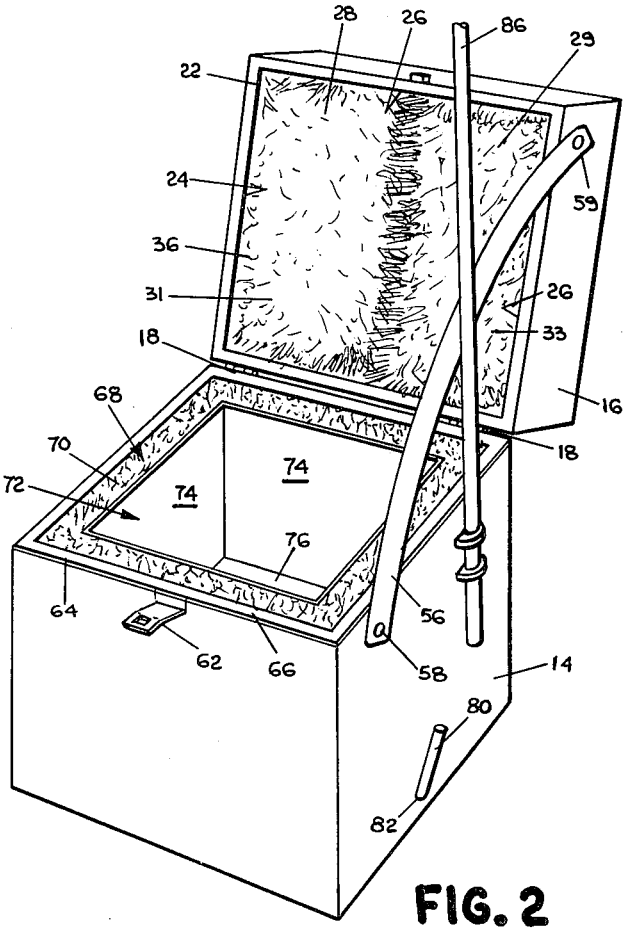
FIG. 2 is a front perspective view of the golf club washer illustrated in FIG. 1 in an open position.

Referring particularly to FIG. 1, the golf club washer 10 includes a container 12 that has a lower portion 14 and an upper portion 16. As shown in FIG. 2, the upper portion 16, is hinged onto the lower portion 14 at a point 18.

The upper portion 16 has an open top 20 and an open bottom 22. Attached at two interior sides 24 and 26 of the upper portion 16 are two cleaning pads 28 and 29 respectively.

Figure 3:
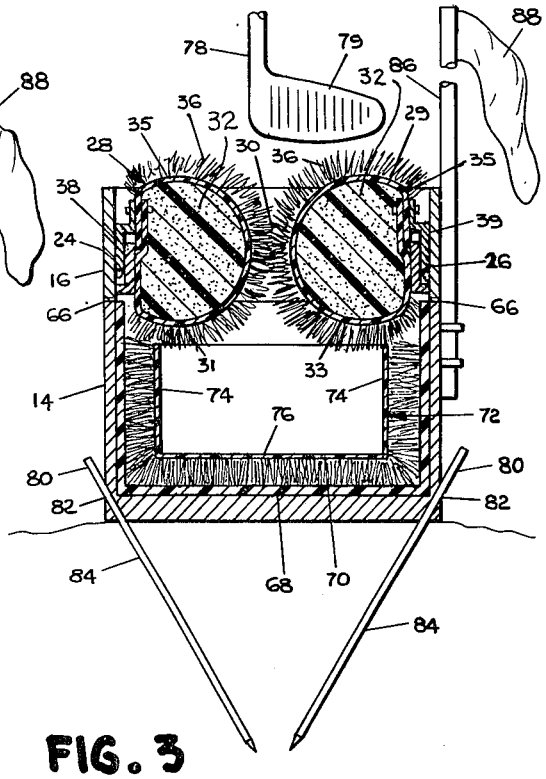
FIG. 3 is a front elevational cross sectional view of the golf club washer as illustrated in FIG. 1.

As shown in FIG. 3, the cleaning pads 28 and 29 have a spongeous interior 32. A narrow gap 30 lies between the spongeous interiors of the two pads 28 and 29. The exterior of each pad 28 and 29 is a synthetic plastic grass 35 having a plurality of synthetic grass-like bristles 36. The bristles 36 flex under pressure and are resilient enough to flex back when the pressure ceases. The cross-sectional shape of each cleaning pad 28 and 29 is circular and has one flattened side 38 and 39 respectively that lies adjacent to the interior sides 24 and 26 respectively of the upper portion 16. The grass-like bristles 36 of each pad 28 and 29 overlap within the gap 30 between the two cleaning pad interiors.

Each of the pads 28 and 29 has an undersurface 31 and 33 respectively. The pads 28 and 29 are suspended so an upper surface 79 of a wood or iron golf club placed through the narrow gap 30 can abut the undersurfaces 31 and 33 thereof.

Figure 4:
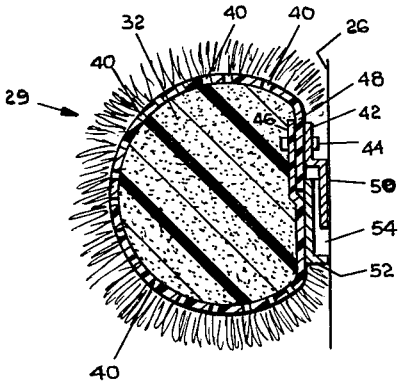
FIG. 4 is an enlarged cross-sectional view of the cleaning pad as illustrated in FIG. 3.

As shown in FIG. 4, the plastic synthetic grass 35 has a plurality of apertures 40 therethrough which are in open communication with the spongeous interior 32.

The plastic synthetic grass 35 is mounted onto the spongeous interior 32 through a metal strap which has apertures therethrough. A threaded fastener 44 engages the strap 42 and two overlapping sections 46 and 48 of the plastic synthetic grass 35.

Figure 5:
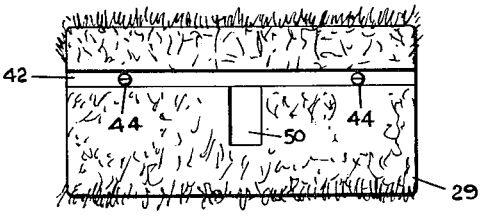
FIG. 5 is a fragmentary side elevational view of the cleaning pad as illustrated in FIG. 4.

As shown in FIG. 4, the cleaning pad 29 is mounted onto the side 26 of the upper portion 16 by a hook 50 which is rigidly fastened to the metal strap 42. The interior side 26 of the upper portion 16 has a hooking receptacle 52 slightly protruding from the interior sides 26. The hook slides between the space 54 of the hooking receptacle 52 and the interior side 26 and is secured therein. As shown in FIG. 5, the metal strap 42 extends a substantial length of the cleaning pad 29. Cleaning pad 28 is mounted in the same fashion onto side 24.

Referring back to FIG. 2, a flexible plastic handle 56 has one end 58 attached to the lower portion 14 and its other end 59 attached to the upper portion 16. When the upper portion 16 is pivotably opened about point 18, the plastic handle 56 limits the movement of the upper portion 16 to a vertically upright position. A latch 62 releasably retains the upper portion 16 is a closed position with respect to the lower portion 14. As shown in FIG. 1, when the top portion 16 is closed and latched, the handle can be grasped to conveniently carry the golf club washer 10.

The lower portion 14 is capable of retaining liquids. The top edge 64 of the lower portion 14 is lined with a thin resilient foam liner 66 to cushion the closing of the upper portion 16 onto the lower portion 14. The interior of the lower portion 14 is lined with a plastic synthetic grass 68 having resilient grass-like blades 70. The synthetic plastic grass 68 can be of the same material as the plastic grass 35 that lines the exterior of the cleaning pads 28. A plastic dish 72 is placed within the central interior section of the bottom section 14. The plastic dish 72 is capable of holding liquid solutions.

As more clearly shown in FIG. 3, the plastic dish 72 is cushioned by the resilient grass-like bristles of the synthetic plastic 68 at all sides 74 of the dish and at the bottom of the dish 76. The dish 72 is placed upright directly below the cleaning pads 28 and 29 and the narrow gap 30. The golf club 78 can be placed over the gap 30 and then pushed down through the gap depressing the spongy interior 32 and the synthetic grass lining 35. The club 78 can be placed within the dish 72 and be wetted by a cleaning solution that is contained within the dish 72. The resilient spongeous material 32 can also be wetted by the solution. When the club 78 depresses the spongeous material 32, the solution will be squeezed from the spongeous material 32 and through the apertures 40 of the plastic grass 35 onto the golf club 78. The resilient grass-like blades 36 rub against the golf club head 78 to clean the golf club. The golf club 78 can be repeatedly agitated through the narrow gap 30 being cleaned by the grass-like blades 36. The undersurfaces 31 and 33 clean the upper surface 38 of the golf club.

As shown in FIG. 3, it is desirable that the golf club washer container 12 is anchored by two long rods 80 and are positioned through two apertures 82. The apertures are angled inwardly and downwardly through the bottom portion 14 of the container 12. The lower portion 84 of the rod 80 extends below the ground level to anchor the container 12 so that it is resistent to tipping over during any thorough agitations or accidental kicks.

As shown in FIGS. 1 and 3, it is desirable that a drying device is provided for with the washing golf club washer 10. The drying device is provided for by a flexible rod 86 attached to the exterior of the golf club washer 10 and extending upwardly. At the top portion of the rod 86 is a towel 88 that is releasably knotted onto the flexible rod.

The golf club washer 10 can be easily maintained. The upper portion 16 can be opened, as shown in FIG. 3, so that the plastic dish 72 containing dirty solution can be removed, emptied to be refilled by clean solution, and be replaced into the interior of the lower portion 12. The cleaning pads can be removed form the upper portion 16 and thoroughly washed and squeezed dry and then replaced into hooking receptable 52. The towel 88 can be easily unknotted from the flexible rod 86 to be replaced by a fresh, clean towel 88.

If for any reason, the golf club washer needs to be moved or taken away, the rods 80 can be uprooted from the ground and the washer can be easily grasped by the handle 56.

In this fashion, a golf club washer is provided that will clean wood or iron golf club heads at any location throughout a golf course and can be easily maintained and be in clean and satisfactory order by a golf club crew during normal maintenance throughout the golf course.

It should be understood that the foregoing embodiment or the invention is merely illustrative of the preferred practice of the invention and that various changes and modifications may be made to the embodiment described herein without departing from the spirit and scope of the invention as defined in the appended claims.

The embodiments of the invention in which an exclusive propertly or privilege is claimed are defined as follows:

1. A golf club washing apparatus comprising:

a liquid holding casing having an aperture at an upper portion and adapted to hold a quantity of liquid placed at a bottom portion therein;

opposed stationary cleaning pads each including a flexible exterior lining that flexes with any pressure thereon, each lining having means thereon for cleaning a golf club head when said golf club head is rubbed thereagainst and a spongeous resilient interior enclosed by the lining so that the golf club head is cushioned against bangs and nicks as the exterior lining flexes; and means for mounting the cleaning pads in an upper portion of the casing such that a club can be inserted through the aperture and between the pads, and in so doing be in rubbing contact with the cleaning pads, there being a space between the bottom surface of the casing and a lower surface of the cleaning pads so that the upper surface of the club can be cleaned by rubbing contact with the lower surface of the cleaning pads.

2. A golf club washing apparatus as defined in claim 1 wherein the cleaning means of each flexible exterior lining comprises outwardly extending resilient bristles.

3. A golf club washing apparatus as defined in claim 2 wherein each flexible exterior lining has a plurality of apertures therethrough to allow passage of liquid solutions to pass to and be stored in the spongeous interior so that when the spongeous interior is compressed by a golf club, the solution is squeezed out of the interior through the apertures and onto the golf club.

4. A golf club washing apparatus as defined in claim 3 wherein each flexible exterior lining is a synthetic grass having a web with a plurality of apertures therethrough and the cleaning means is a plurality of grass-like synthetic bristles extending from the web.

5. A golf club washing apparatus as defined in claim 1 wherein the two cleaning pads are mounted within the container with a narrow gap between the spongeous interiors; the narrow gap is in alignment with the aperture so that a club positioned through the aperture is positioned through the gap; the gap is narrower than a golf club head so that the golf club head will contact the flexible exterior lining and depress the spongeous interior.

6. A golf club washing apparatus as defined in claim 5 wherein each flexible exterior lining has outwardly extending flexible bristles and the bristles of one cleaning pad intermesh with the bristles of the second cleaning pad within the narrow gap.

7. A golf club washing apparatus as defined in claim 5 wherein the interior of the lower portion is lined with the synthetic grass and a container capable of fitting a golf club head is positioned thereon and is cushioned on the synthetic grass bristles such that the golf club is allowed to be dipped into the solution within the container and the resiliency of the bristles prevents any nicks on the golf club when hitting the side of the container.

8. A golf club washing apparatus as defined in claim 1 wherein each cleaning pad is releasably mounted in a horizontal fashion to the upper portion of the casing.

9. A golf club washing apparatus as defined in claim 1 wherein the casing has an upper portion pivotally mounted to the lower portion; the lower portion having an open top so that the open top is exposed when the upper portion is pivoted to an open position.

10. A golf club washing apparatus as defined in claim 1 and further comprising a means for anchoring the casing to the ground.

11. A golf club washing apparatus as defined in claim 10 wherein the anchoring means includes at least two inclined apertures extending through a lower portion of the casing, a rod extending through each aperture having a lower section extending downwardly from the aperture and extending through the ground to be secured therebelow.

12. A golf club washing apparatus as defined in claim 1 further comprising a drying means including a pole extending upwardly from the casing and a towel releasably fastened to an upper portion of the pole for drying a golf club after being washed within the casing.

13. A golf club washing apparatus comprising:

a liquid holding casing having an aperture at an upper portion and adapted to hold a quantity of liquid placed at a bottom portion therein;

a cleaning pad forming at least one side of the aperture and including a flexible exterior lining that flexes with any pressure thereon, the lining having means thereon for cleaning a golf club head when said golf club is rubbed thereagainst, and a spongeous resilient interior enclosed by the lining so that the golf club head is cushioned against bangs and nicks as the exterior lining flexes; and means for mounting the cleaning pad to an upper portion of the casing comprising:

a hook means extending outwardly and downwardly from the back surface of the cleaning pad;

a hook receiving means secured to the inside surface of an upper portion of the casing for releasably coupling the hook means securely to a wall of the casing wherein the cleaning pad is mounted to an upper portion of the casing such that the club can be inserted through the aperture and adjacent the pad, and in so doing be in rubbing contact with the cleaning pad, there being a space between the bottom surface of the casing and a lower surface of the cleaning pad so that the upper surface of the club can be cleaned by rubbing contact with the lower surface of the cleaning pad.

* * * * *